US005245147A

United States Patent [19]

Kobayashi

[11] Patent Number: 5,245,147

[45] Date of Patent: Sep. 14, 1993

[54] PUSH BUTTON SWITCH

[75] Inventor: Masato Kobayashi, Iwaki, Japan

[73] Assignee: Alps Electric Co., Ltd., Tokyo, Japan

[21] Appl. No.: 839,646

[22] Filed: Feb. 21, 1992

[30] Foreign Application Priority Data

Feb. 22, 1991 [JP] Japan ..... 3-48790

[51] Int. Cl.[5] ..... H01H 13/14

[52] U.S. Cl. ..... 200/520; 200/293; 200/333

[58] Field of Search ..... 200/520, 293, 294, 333, 200/341, 521, 510, 534, 517, 309, 308

[56] References Cited

U.S. PATENT DOCUMENTS

| | | | |
|---|---|---|---|
| 3,354,284 | 11/1967 | Knecht | 200/284 |
| 4,894,498 | 1/1990 | Kagawa et al. | 200/534 |
| 5,055,642 | 10/1991 | Miyata | 200/293 |
| 5,124,515 | 6/1992 | Mous | 200/518 |

*Primary Examiner*—Henry J. Recla
*Assistant Examiner*—David J. Walczak
*Attorney, Agent, or Firm*—Guy W. Shoup; David W. Heid

[57] ABSTRACT

The present invention relates to a push button switch which is capable of preventing deformation of a belt-like metallic plate serving as a terminal of the push button switch during its insertion molding process into the housing of the push button switch.

To this end, a push button switch comprises a square housing, a belt-like metallic plate inserted in the housing so as to penetrate the housing, the housing having an outer wall from which the belt-like metallic plate protrudes outward, the belt-like metallic plate having an inner portion exposing from a bottom surface of the housing and an outer portion extending outward from the outer wall of the housing, and the outer wall being planed-off obliquely at a portion where the belt-like metallic plate protrudes.

Therefore, the span of the belt-like metallic plate becomes short. Thus, the push button switch can be made compact in size.

3 Claims, 3 Drawing Sheets

PUSH BUTTON SWITCH

BACKGROUND OF THE INVENTION

1. Field of the Invention

The present invention relates to a small push button switch having a housing which is formed in such a manner that a belt-like metallic plate is inserted in the housing. This belt-like metallic plate serves as a basic material of a fixed contact or a terminal of the push button switch.

2. Description of the Related Art

FIG. 8 is a plane view showing a housing of this kind of push button switch as a related sample. In the drawing, a push button switch comprises a housing 1 formed by being inserted two belt-like metallic plates 2, 3 extending in parallel with each other. The housing 1 has a rectangular configuration when seen from the top, and has opening 1*a* therein. At an inner bottom surface of the housing 1, there is exposed a central fixed contact 4 and a circumferential fixed contact 5 so as to be spaced with each other.

The central fixed contact 4 is made of a part of one belt-like metallic plate 2, to the contrary the circumferential fixed contact 5 is made of a part of the other belt-like metallic plate 3. Both end portions of each belt-like metallic plate 2 or 3 are formed in a terminal shape by being bent to serve as a terminal, respectively. That is, the belt-like metallic plate 2 or 3 has a pair of projecting portions protruding from an outer wall surface 1*b* of the housing 1 in opposite directions with each other.

These projecting portions are to serve as terminals 6 or terminals 7 in the drawing. Each terminal 6 or 7 has a stepped portion 6*a*, 7*a*, each being bent in a cranked-shape along the outer wall surface 1*b* of the housing 1. A distal end of respective terminal 6 or 7 protruding from each stepped portion 6*a* or 7*a* is a part serving as a soldering part. That is, this soldering part is soldered at predetermined position of a printing circuit pattern substrate.

Furthermore, there is provided a movable contact formed in a dome-shaped configuration (not shown). This movable contact is disposed on the circumferential fixed contact 5 so that a central part of the movable contact can be pushed downward to contact with the central fixed contact 4. Thereby, both fixed contacts 4 and 5 can be electrically associated to conduct an electricity by manipulating the movable contact. Namely, the switch is changed its condition from an OFF-condition to an ON-condition.

In such a push button switch, the belt-like metallic plate 2 or 3 penetrating the housing 1 is cut into a predetermined shape through a press processing and, in turn, is inserted into molding dies with keeping its hoop-condition so as to be integrated with a housing 1.

In the case that the push button is made small, a thickness of the belt-like metallic plate 2 or 3 serving as a basic material for the fixed contacts 4, 5 or the terminals 6, 7 becomes thin. Usually its thickness is a level of 0.1 mm. Therefore, this thin belt-like metallic plate 2 or 3 is likely to be deformed by the pressure of melted resin when it is inserted into the housing during the molding operation. As a result, it was feared that the fixed contacts 4 and 5 do not protrude a predetermined amount on the inner bottom surface of the housing 1 and, consequently to fail performing a switching operation to conduct an electricity.

Moreover, it is desirable for this kind of button switch to reduce a protruding amount of each terminal 6 or 7 with respect to housing 1. However, it is also necessary to keep a sufficient area for a soldering operation more than a predetermined area at a front end portion of each terminal 6 or 7. Thus, it was not possible to reduce the protruding amount of each terminal 6 or 7 by a large amount at once. Accordingly, the maximum span of the belt-like metallic plate 2 or 3 results in becoming fairly larger in size than the maximum outer radius of the housing 1 of the same direction. And thus, it was difficult to provide a desirably compact button switch in size.

SUMMARY OF THE INVENTION

It is therefore an object of the present invention, in order to resolve the aforementioned problems and disadvantages encountered in the art, to provide an improved push button switch which is capable of preventing the belt-like metallic plate serving as a basic material for the fixed contacts or the terminals from deforming during its molding processing, as well as, reducing size to realize a desirable compact button switch.

The purposes described above can be realized in such a manner that the outer wall surface of the housing is planed off at the portion where the terminal protrudes so as to cross the terminal obliquely.

In accordance with the present invention, the total longitudinal length of the belt-like metallic plate becomes shorter when at least one terminal is protruded from the planed-off portion on the outer wall surface of the housing, since inside length of the belt-like metallic plate molded in the housing body becomes shorter by an amount the outer wall surface is planed off. As the inside length of the belt-like metallic plate molded in the housing body becomes shorter, it becomes easier to insert it without causing deformation during the molding operation. Furthermore, the maximum span of the belt-like metallic plate itself becomes short.

The above and other objects, features and advantages of the present invention will become apparent from the following detailed description which is to be read in conjunction with the accompanying drawings.

BRIEF DESCRIPTION OF THE ACCOMPANYING DRAWINGS

Figure 5A:
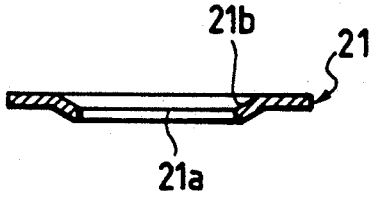
Figure 5B:
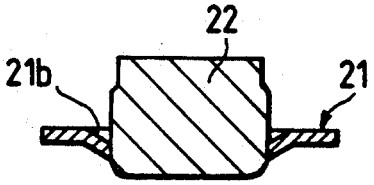
Figure 5C:
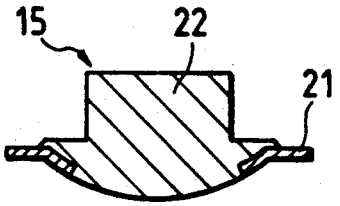
Figure 6:
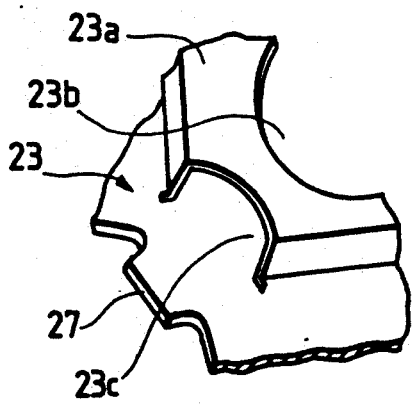
Figure 7:
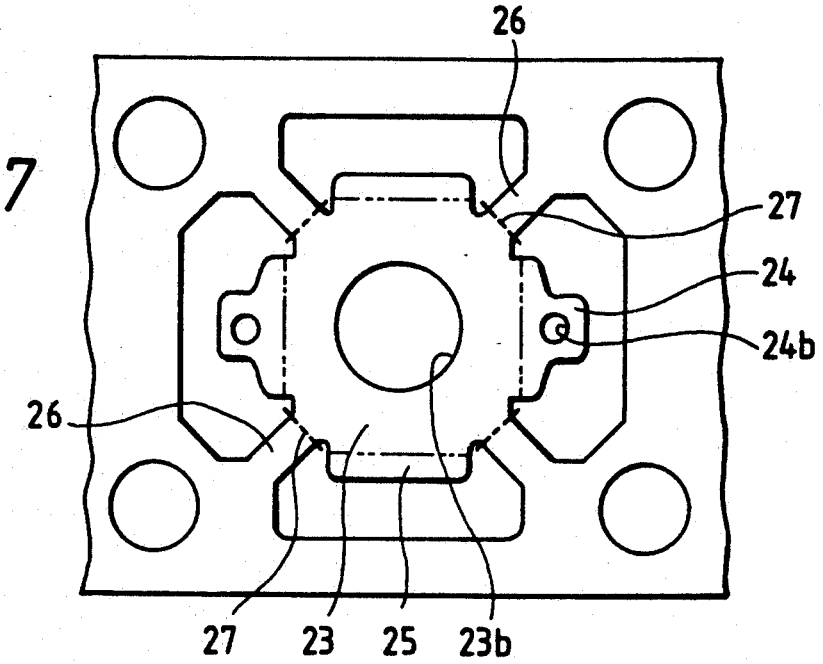
Figure 8:
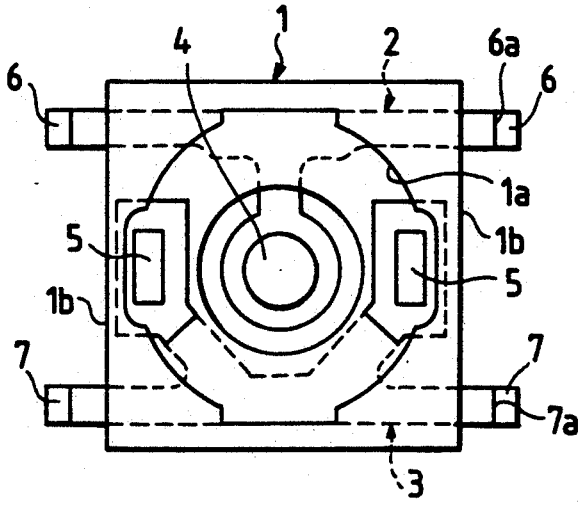
FIG. 8 PRIOR ART

FIGS. 5(*a*)–5(*c*) are views showing manufacturing steps of a stem adopted for the push button in accordance with the present invention;

FIG. 6 is a perspective view showing an essential portion of a frame body adopted for the push button in accordance with the present invention;

FIG. 7 is a plane view showing the frame body shown in FIG. 6 which is still in a hoop condition; and FIG. 8 is a plane view of a housing for a prior art push button switch.

DETAIL DESCRIPTION OF THE PREFERRED EMBODIMENT

Hereinafter, referring now to FIGS. 1 to 7, a preferred embodiment of the present invention is explained in more detail. In the drawings, a push button switch is a small type, which has an essentially square configuration of around 5 mm in width and 1.5 mm in thickness. The push button switch has a housing 10, which is octagonal configuration when seen from the top.

The push button further comprises a pair of belt-like metallic plates 11 and 12 each extending in parallel with each other. These pair of belt-like metallic plates 11 and 12 are inserted into the molding dies at the same time the housing 10 is molded. There is also provided a movable contact 13 which is formed in a dome-shape and is accommodated in the housing 10. A dust cover sheet 14 is provided on an opening 10*a* of the housing 10 to cover the opening 10*a* so as to prevent dust from entering. The dust cover 14 is made of flexible material.

There is further provided a stem 15 so as to be located over the dust cover 14. That is, through the dust cover 14, the stem 15 pushes the movable contact 13 to move together downward when it is forced to cause a downward movement. Still further, the push button switch comprises a frame body 16, which fixedly presses the periphery portion of the dust cover 14 and is secured to the housing 10 so that the stem 15 can be inserted therethrough.

The housing 10 has about 0.65 mm thickness, and its four corner portions are planed off. Therefore, its maximum outer radius is shorter than that of a square-shaped housing having an equivalent width, if compared.

Figure 2:
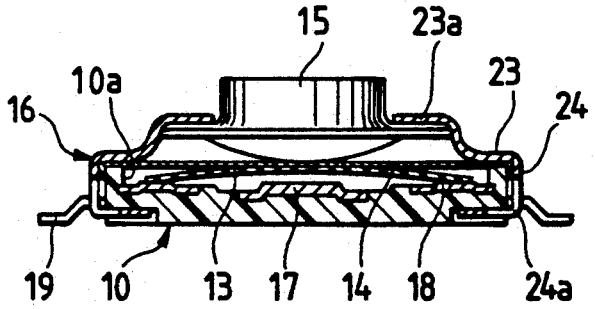
FIG. 2 is a cross-sectional view of the push button switch shown in FIG. 1.
Figure 3:
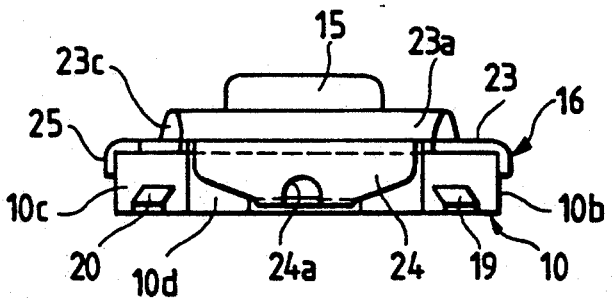
FIG. 3 is a side view of the push button switch shown in FIG. 1.
Figure 4:
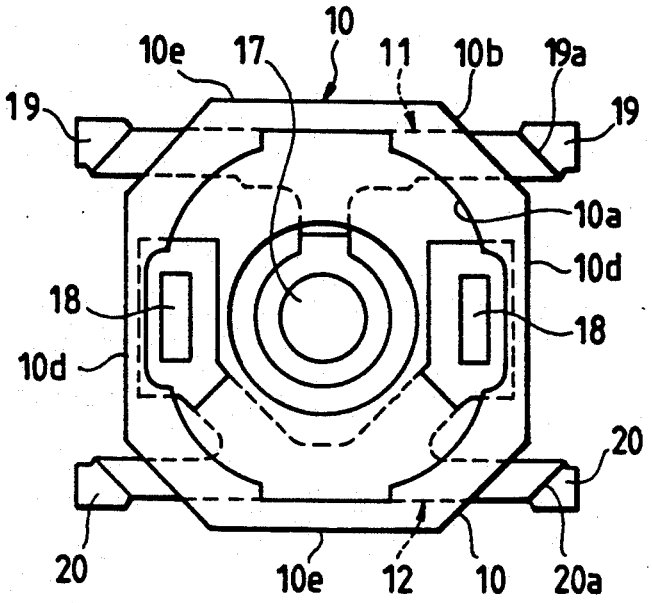
FIG. 4 is a plane view showing a housing applied for the push button switch in accordance with the present invention.

As is apparent from FIGS. 2 and 4, at an inner bottom surface of the housing 10, there are exposed a pair of a central fixed contact 17 and a circumferential fixed contact 18 so as to be spaced with each other. The central fixed contact 17 is made of a part of the belt-like metallic plate 11, to the contrary the circumferential fixed contact 18 is made of a part of the other belt-like metallic plate 12. Both end portions of the belt-like metallic plate 11 are formed in a terminal shape so as to serve as a terminal 19, respectively.

Each of the terminals 19 protrudes from the planed-off portion 10*b* provided on each side of the housing 10 and extends toward an opposite direction with each other. One end of the terminal 19 is supported to the outer wall surface of the housing 10; i.e. the planed-off portion 10*b*. Each terminal 19 has a stepped portion 19*a* which is formed by being bent in a cranked-shape along the planed-off portion 10*b*.

A distal end of respective terminal 19 protruding from each stepped portion 19*a* is a part serving as a soldering part. That is, this soldering part is soldered at predetermined position of a printing circuit pattern substrate.

In the same way, both end portions of the belt-like metallic plate 12 are formed in a terminal shape so as to serve as a terminal 20, respectively.

Each of the terminals 20 protrudes from the planed-off portion 10*c* provided on each side of the housing 10 and extends toward an opposite direction with each other. One end of the terminal 20 is supported to the outer wall surface of the housing 10; i.e. the planed-off portion 10*c*. Each terminal 20 has a stepped portion 20*a* which is formed by being bent in a cranked-shape along the planed-off portion 10*c*.

A distal end of respective terminal 20 protruding from each stepped portion 20*a* is a part serving as a soldering part. That is, this soldering part is soldered at predetermined position of a printing circuit pattern substrate.

The movable contact 13 is known as a so-called reversal switch, which causes a click feeling when pushed into a predetermined amount and turned from side to side. When the pushing force applied thereon is removed, this movable switch 13 restores to the original dome-shaped configuration. This movable contact 13 is mounted on the circumferential fixed contact 18 in the housing 10 so that a central portion of the movable contact 13 cab be contacted with the central fixed contact 17.

The dust cover sheet 14 is adhesively fixed on an upper edge surface of the housing 10 so as to conceal the opening 10*a*. That is, the dust cover sheet 14 serves to prevent the central fixed contact 17 and the movable contact 13 from being contaminated by entering dust. Namely, if dusts enter into a gap between the central fixed contact 17 and the movable contact 13, it is feared to cause a failure in conductivity between these contacts 17 and 13. Accordingly, the contact portion of the push button switch is concealed by the dust cover sheet 14 in advance. Thus, it can be surely indemnified to prevent dusts from entering and causing troubles.

The stem 15 is consisted of an integrated two kind of metallic materials, which are a pair of a hard and a soft metallic materials. In detail, the stem 15 is constituted by a first metallic material 21 and a second metallic material 22. The first metallic material 21 has a through hole 21*a* at a center thereof. There is formed a tapered surface 21*b* in the periphery of the through hole 21*a*. The first metallic material 21 chiefly serves as a flange, and is made of stainless.

On the other hand, the second metallic material 22 is made of relatively soft metallic material such as a brass. The second metallic material 22 is to be press-fitted into the through hole 21*a* to constitute a main body of the stem 15.

Now, manufacturing steps of the stem 15 are explained by referring to FIG. 5. First of all, as shown in FIG. 5(*a*), the first metallic material 21 is cut into a predetermined configuration in advance. Then in this step, the first metallic material 21 is processed through a stamping operation. As a result of this stamping operation, the first metallic material 21 is finished into a flange-shaped metallic plate having the through hole 21*a* surrounded by the tapered surface 21*b*.

Next, as shown in FIG. 5(*b*), the second metallic material 22 is stamped out as a caulking ball in advance. And, in this step, the second metallic material 22 is press-fitted into the through hole 21*a*, and subsequently, is processed by a press operation. With this press operation, the second metallic material 22 protrudes with a curved surface from the through hole 21*a*. And the second metallic material 22 itself is press-fixed on the tapered surface 21*b*. At the same time, the body of the second metallic material 22 is formed in a predetermined configuration. Thus, the first and the second metallic materials 21 and 22 are integrated to form a predetermined-shaped stem 15.

Thus obtained stem 15 is, as shown in FIG. 2, mounted on the movable contact 13 through the dust cover sheet 14. Therefore, the stem 15 is held movable in an up-and-down direction with respect to the housing 10. On the other hand, the frame body 16 described in detail later fixes the flange portion of the stem 15. Thus, the uppermost position of the stem 15 reachable in its vertical stroke is restricted by the frame body 16. Accordingly, it is not feared that the stem 15 is accidentally fallen out of the housing 10.

The frame body 16 is manufactured into a configuration as shown in FIG. 7 by punching a hoop-shaped metallic plate. This frame body 16 is fixedly mounted on the housing 10 through the dust cover sheet 14 so as to cover the opening 10*a*. That is, this frame body 16 has substantially the same configuration as the housing 10 when seen from the top.

And further, the frame body 16 comprises a cover plate portion 23 disposed on the dust cover sheet 14, a pair of first leg pieces 24 each elongated from opposite left or right side edge of the cover plate portion 23 and bent along the outer wall surface 10*d* and the bottom surface of the housing 10, and a pair of second leg pieces 25 each elongated from opposite upper or lower side edge of the cover plate portion 23 and bent along the outer wall surface 10*e* and the bottom surface of the housing 10. The directions applied in the above explanation is defined in accordance with the drawing of FIG. 7.

In the cover plate portion 23, there is formed a protruding portion 23*a* formed into a slightly small octagonal shape through a drawing processing. At a center of this protruding portion 23*a*, there is formed a penetrating hole 23*b* for inserting the main body of the stem 15. Moreover, as apparent from FIGS. 2 and 3, on the first leg piece 24 that is formed into a relatively long shape, there is provided a through hole 24*a*. This through hole 24*a* is just located on a predetermined position corresponding to the corner portion extending from the outer wall surface 10*d* to the bottom surface of the housing 10. This is to facilitate folding the first leg piece 24 at both sides of the through hole 24*a*. By this arrangement, the first leg piece 24 can be bent along the housing in such a manner that the tip end of the first leg piece 24 is engagedly fixed on the bottom surface of the housing 10. Thus, the frame body 16 can be surely secured to the housing 10.

Furthermore, there is formed a crosspiece 26 at each of four corners of the cover plate portion 23 in the hoop-shaped metallic plate as shown in FIG. 7. A cutting portion 27 for separating each crosspiece 26 and the frame body 16 is placed exactly on the planed-off portions 10*b* or 10*c*. Accordingly, each crosspiece 26 does not restrict width sizes of the first and the second leg pieces 24, 25 of the frame body 16.

Figure 1:
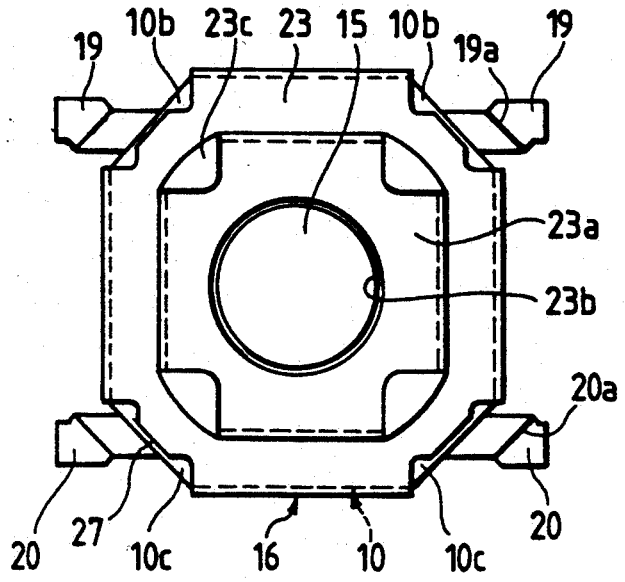
FIG. 1 is a plane view showing a push button switch in accordance with a preferred embodiment of the present invention.

Moreover, as apparent from FIGS. 1 and 6, the protruding portion 23*a* to be formed into the octagonal shape through the drawing process is formed a cutout 23*c* at each of four corners in advance before drawing processing. This cutout 23*c* is effective to prevent crack causing during the drawing processing. That is, each corner was a trigger point of crack. However, by providing the cutout 23*c*, the generation of crack is surely prevented.

The push button switch constructed as explained above in the foregoing description can make the movable contact 13 generate click feeling when the stem 15 is pushed down a predetermined amount. Subsequently, the movable contact 13 turns from side to side and contacts with the central fixed contact 17. Through this movable contact 13, the central fixed contact 17 and the circumferential fixed contact 18 are associated so as to conduct an electricity. Then, the switch is changed its condition from the OFF-condition to the ON-condition. Further, if the pushing force applied on the stem 15 is removed in this condition, the reversed movable contact 13 restores to the original dome-shape by virtue of its inherent spring nature. At this moment, the switch is again changed from the ON-condition to the OFF-condition. And, the stem 15 rises up to the position that the flange of the stem 15 is stopped by the protruding portion 23*a* of the frame body 16.

As is explained, according to above embodiment, the terminals 19 and 20 are provided so as to protrude from the planed-off portions 10*b*, 10*c*. Thus, the longitudinal size of each belt-like metallic plate 11 or 12 molded in the housing 10 becomes shorter by the amount the planed-off portion 10*b* or 10*c* is retracted. For this arrangement, the likelihood that the belt-like metallic plates 11 and 12 are deformed by the resin pressure during its insertion molding process can be decreased. Therefore, it is surely possible to protrude the fixed terminals 17 and 18 a predetermined amount on the inner bottom surface of the housing 10.

In other words, even if the thicknesses of the belt-like metallic plates 11 and 12 are reduced in order to provide a compact push button switch, each belt-like metallic plate 11 or 12 having shorter longitudinal size is not so weak against a bending or torsion force. Therefore, it means there is provided a stronger structure capable of suppressing the fixed contacts 17 and 18 from being dislocated due to the resin pressure as less as possible.

Furthermore, since the size between the opposite planed-off portions 10*b* or 10*c* of the housing 10 is shorter than the size between the opposite outer wall surfaces 10*d* of the housing 10, the maximum span of each belt-like metallic plate 11 or 12 is not so large if compared with the maximum outer radius of the housing 10 measured in the same direction. Moreover, the terminals 19 and 20 have stepped portions 19*a* and 20*a*, respectively. These stepped portions 19*a* and 20*a* are formed by being bent along the planed-off portions 10*b* and 10*c*, respectively. It is possible not only to keep a minimum area necessary for soldering but also to reduce the projecting amount of each terminal 19 or 20. As a result, the maximum span of each belt-like metallic plate 11 or 12 can be further shortened.

Moreover, in the above embodiment, the stem 15 is made of metal; i.e. not by resin material. It is not necessary to pay attention on the difference of thermal expansion ratio or traces of injection gates. If compared with the conventional stem made of only synthetic resin material, the flange portion of the stem 15 can be manufactured into a thin flange. Further, if compared with another conventional stem consisted of a combined metallic material and a synthetic resin material integrally molded through an insertion molding process, the stem 15 has a higher reliability. In addition, this stem 15 can be easily manufactured by pressing a pair of hard and soft metallic materials 21 and 22. Thus, this is preferable for the purpose of mass production of stems.

Yet further, in the above embodiment, the first leg piece 24 of the frame body 16 is bent along the outer wall surface 10*d* and the bottom surface of the housing 10. And further, the first leg piece 24 is provided the through hole 24*a* to facilitate folding operation of the first leg piece 24 at both sides of the through hole 24*a* without causing spring back phenomenon. Thus, the frame body 16 can be securely fixed to the housing 10 even if the push button switch is too small to apply a caulking fixation or a snap-in fixation.

And, the front end of the first leg piece 24 extending on the bottom surface of the housing 10 comes to face to a printing substrate loading this push button switch. Therefore, it is easy to connect the front end of the first leg piece 24 on the circuit pattern of the printing substrate by means of soldering. Thus, the first leg piece 24 can be utilized as a ground terminal.

Still further, the frame body 16 is installed on the housing 10 by being applied a bending operation, while four corners of the cover plate portion 23 are still connected with crosspieces 26 of the hooped-metallic plate. The first leg piece 24, the second leg piece 25, and the crosspiece 26 are arranged not to align together on one side of the cover plate portion 23. That is, crosspiece 26 is considered not to interfere with each leg piece 24 or 25. Thus, it becomes possible to design each leg piece 24 or 25 relatively wide in a size, even though the push button switch is an extremely small switch that is impossible to form the side of the cover plate portion 23 longer. Therefore, it is not feared that the shortage of fixing area for the dust cover sheet 14 or lack of installation strength of the frame body 16 occurs.

Furthermore, on the cover plate portion 23 of the frame body 16, there is provided a cutout **23*c* for preventing the generation of crack. This cutout 23*c* is formed in advance before drawing processing for forming the protruding portion 23*a***. Thus, it becomes possible to improve yield rate, or to extend life of products.

Though, in the above embodiment, the housing 10 is an octagonal configuration when seen from the top and each terminal 19 or 20 protrudes from the planed-off portion **10*b* or 10*c* provided at each corner of the housing 10**, the present invention is not limited only to this embodiment. For example, the configuration of the housing can be formed as a hexagonal shape. And also, it is allowed to let the terminal protrude from only one planed-off portion of the outer wall surface of the housing.

Still further, though the above embodiment is explained based on the push button switch in which a stem is assembled in a protruding portion formed on a metallic frame body, the present invention can be also applied to a push button switch that has no protruding portion on a frame body.

In accordance with the present invention, the longitudinal size of each belt-like metallic plate molded in the housing becomes shorter by the amount the planed-off portion is retracted. For this arrangement, the likelihood that the belt-like metallic plates are deformed by the resin pressure during its insertion molding process can be decreased. Therefore, it is surely possible to protrude the fixed terminals a predetermined amount on the inner bottom surface of the housing.

Further, the maximum span of each belt-like metallic plate is not so large if compared with the maximum outer radius of the housing measured in the same direction. Thus, it becomes possible to provide an excellent push button switch having high reliability and capable of reducing its size.

Moreover, if there is provided a stepped portion on each terminal, it becomes possible not only to keep a minimum area necessary for soldering but also to reduce the projecting amount of each terminal.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A push button switch comprising:

a housing having a plurality of chamfered outer surfaces;

a plurality of conductive plates disposed in said housing, each said conductive plate having an associated first surface and at least one end portion extending out of one of said chamfered outer surfaces along an associated first direction, said one of said chamfered outer surfaces disposed obliquely to said associated first direction;

a terminal formed on each end portion;

a fixed contact disposed in said housing, said fixed contact electrically connected to at least one of said conductive plates; and a movable contact disposed in opposition to the fixed contact, said movable contact electrically connected to at least one other of said conductive plates, said movable contact actuated to electrically contact said fixed contact.

2. A push button switch according to claim 1 further comprising:

a step portion formed at each end portion of each conductive plate whereby a surface of said step portion intersects said associated first surface along a line which lies at an oblique angle with respect to said associated first direction wherein said terminal is formed on said step portion.

3. A push button switch according to claim 2 wherein said housing has a substantially octagonal shape.

* * * * *